US008052016B2

(12) United States Patent
Wang

(10) Patent No.: US 8,052,016 B2
(45) Date of Patent: Nov. 8, 2011

(54) DUAL TUBE CONTAINER WITH ONE WAY VALVES AND APPLICATOR

(75) Inventor: Ming Yuan Wang, Guangdong (CN)

(73) Assignee: UDN Packaging Corp., Guangdong (CN)

( * ) Notice: Subject to any disclaimer, the term of this patent is extended or adjusted under 35 U.S.C. 154(b) by 187 days.

(21) Appl. No.: 12/488,978

(22) Filed: Jun. 22, 2009

(65) Prior Publication Data

US 2009/0277912 A1 Nov. 12, 2009

(30) Foreign Application Priority Data

Dec. 5, 2008 (CN) ..... 2008 1 0218112

(51) Int. Cl.
*B67D 3/00* (2006.01)

(52) U.S. Cl. ..... 222/489; 222/482; 222/485; 220/526

(58) Field of Classification Search ..... 220/526; 222/478, 481, 481.5, 482, 488, 489; 401/265, 401/266

See application file for complete search history.

(56) References Cited

U.S. PATENT DOCUMENTS 3,729,553 A * 4/1973 Gold et al. ..... 424/44
4,520,921 A * 6/1985 Vissing ..... 206/1.5
4,752,014 A * 6/1988 House et al. ..... 215/216
4,948,002 A * 8/1990 Thornock et al. ..... 215/221
5,152,432 A * 10/1992 De Laforcade ..... 222/145.1
5,230,433 A * 7/1993 Hamilton et al. ..... 215/221
5,392,947 A * 2/1995 Gentile ..... 220/665
5,398,846 A * 3/1995 Corba et al. ..... 222/1
5,449,077 A * 9/1995 Seidler ..... 215/216
5,551,582 A * 9/1996 Robinson ..... 215/216
5,564,580 A * 10/1996 Hamilton et al. ..... 215/209
5,603,421 A * 2/1997 Opresco ..... 215/217
5,687,863 A * 11/1997 Kusz ..... 215/216
5,706,963 A * 1/1998 Gargione ..... 215/219
5,722,546 A * 3/1998 Briere ..... 215/216
5,735,417 A * 4/1998 Darr et al. ..... 215/216
5,765,705 A * 6/1998 Deubel ..... 215/216
5,865,330 A * 2/1999 Buono ..... 215/216

(Continued)

*Primary Examiner* — J. Gregory Pickett
*Assistant Examiner* — Ned A Walker
(74) *Attorney, Agent, or Firm* — Jackson IPG PLLC; Demian K. Jackson

(57) ABSTRACT

A dual tube container with one way valves comprises an outer tube and a cap, wherein, the tube head of the outer tube is provided with a base plate; the base plate is provided with a left through hole and a right through hole connecting the outer tube and the inner tube; a connector extends downwards from the right through hole, and the inner tube body in the outer tube body is connected to the connector to form the inner tube; a pair of one way valves are fixed in the tube head; an applicator with a orifice is inserted into the tube head; when the cap is put on to close the tube head, the pintle or elastic gasket in the cap sealing the orifice on the daub part of the applicator to prevent the leaking of liquid contents. It is provided with a pair of one way valves, and the inner tube is fixed in the outer tube; via the opening or closing of the pair of one way valves, the contents of the outer tube and the inner tube are permitted or forbidden to flow out. By using the dual tube container to make a cosmetic apparatus, etc., the technology of filling two kinds of pastes can be implemented via the big holes in the tube head, so as to avoid adopting expensive special equipment for filling and sealing; the operation is greatly simplified, and the cost is reduced.

9 Claims, 3 Drawing Sheets

U.S. PATENT DOCUMENTS 5,908,125 A * 6/1999 Opresco ..... 215/216
5,938,086 A * 8/1999 Gross ..... 222/494
6,036,036 A * 3/2000 Bilani et al. ..... 215/216
6,082,588 A * 7/2000 Markey et al. ..... 222/137
6,296,130 B1 * 10/2001 Forsyth et al. ..... 215/219
6,321,947 B2 * 11/2001 Gross et al. ..... 222/145.1
6,357,615 B1 * 3/2002 Herr ..... 215/216
6,398,077 B1 * 6/2002 Gross et al. ..... 222/145.1
6,550,647 B1 * 4/2003 Kunz ..... 222/129
6,609,637 B1 * 8/2003 Suffa ..... 222/545
6,640,999 B2 * 11/2003 Peterson ..... 222/135
6,669,048 B2 * 12/2003 Eva et al. ..... 220/524
6,672,487 B1 * 1/2004 Lohrman ..... 222/213
6,769,573 B1 * 8/2004 Kazarian et al. ..... 222/136
6,786,363 B1 * 9/2004 Lohrman ..... 222/213
6,854,619 B2 * 2/2005 Knickerbocker ..... 222/1
6,866,164 B2 * 3/2005 Branson et al. ..... 222/153.14
7,007,523 B2 * 3/2006 Belden, Jr. ..... 70/57.1
7,090,097 B1 * 8/2006 Kazarian et al. ..... 222/144.5
7,100,785 B1 * 9/2006 Suffa ..... 215/330
7,334,694 B2 * 2/2008 Suffa ..... 215/216
7,552,832 B2 * 6/2009 Suffa ..... 215/236
7,815,062 B2 * 10/2010 Suffa ..... 215/221
2001/0013523 A1 * 8/2001 Gross et al. ..... 222/94
2003/0173364 A1 * 9/2003 Eva et al. ..... 220/524
2004/0182814 A1 * 9/2004 Suffa ..... 215/216
2005/0133475 A1 * 6/2005 Goto et al. ..... 215/237
2006/0180617 A1 * 8/2006 Suffa ..... 222/485
2006/0191804 A1 * 8/2006 Suffa ..... 206/219
2007/0278174 A1 * 12/2007 Kunz et al. ..... 215/224

* cited by examiner

DUAL TUBE CONTAINER WITH ONE WAY VALVES AND APPLICATOR

BACKGROUND OF THE INVENTION

1. Field of the Invention

The present invention involves the technical field of packing pasty products, especially involves a dual tube container with one way valves, and a method for making the dual tube container with applicator, which contains two kinds of pro rata pastes in the inner, and outer tubes, by the built-in one way valves being opened or closed, to allow or forbid the two pastes to flow out 2. Description of the Related Art Currently, plastic tube is widely used to products of cosmetics, medicine, food, dentifrice, medical ointment, excite mostly adopts a single tube structure of squeeze type, which contains pasty cosmetics, etc. in a tube, and while being used, the cap is opened, and the tube is squeezed to make the pasty cosmetics flow out to be used. Some cosmetics, such as a sunscreen lotion, a lipstick, a lip balm, or a hair dye, often require that multiple pastes are pro rata blended to be used, which currently are still separately packed with a single tube, so the product cost is increased. While being used, each single tube is separately opened to separately squeeze two kind of pastes out to be blended before being used, which are not convenient for using and carrying.

A Taiwan patent with the publication number of M297920 disclosed an improved dual tube container structure. The improved dual tube container structure comprises an inner tube, an outer tube, a middle sleeve, and a spigotjoint provided with an outlet and an inlet; the middle sleeve close contacts the spigotjoint to be connected by socket joint; the gear seat below the spigotjoint and the registering section at the lower section of the middle sleeve are together squeezed into the tube orifice of the outer tube, so as to make the spigotjoint and the middle sleeve to be fixed to the tube orifice part of the outer tube. By this design, different cosmetics can be separately filled in the inner tube and the outer tube, and at the same time two kinds of pro rata cosmetics can be squeezed out to be blended to use, so as to provide convenience to the users.

But in this improved structure, the fixing of the inner tube and outer tube needs implement via the parts such as the spigotjoint and the middle sleeve with complicated shapes; the complicated structure make the product cost to increase. Besides, the improved structure has no valve switch; the external liquid out path in the spigotjoint keeps being connected to the outlet of the spigotjoint all along; the outlet of the liquid out path of the inner tube keeps opening all along; the pastes (or the contents) in the inner tube and the outer tube are blended at the outlets in the tubes; the pastes at each outlets easily get bad or dry, leading to the blocking phenomenon. At the same time, when the tube is squeezed to generate a resilience pressure, the blended contents at the outlets in the tubes will be sucked back into the tubes, which causes the contents separately contained in the inner tube and the outer tube to be polluted, so, the contents being separately contained in the inner tube and the outer tube loses its meaning.

Besides, the external liquid out path in the spigotjoint is comparatively long, and each outlet is small, so it can only fits the traditional technology that the contents are separately filled from the tube tail before the tube tail is sealed.

SUMMARY OF THE INVENTION

To avoid the above mentioned disadvantages that exist in the existing tube container technology for containing pastes of cosmetic, etc., the present invention provides a kind of dual tube container with one way valves, and a method for making the dual tube container with applicator. Its inner tube is located in the outer tube by socket joint; when the cap is opened, via the opening or closing of the built-in one way valves, two kinds of pastes are permitted or forbidden to flow out; at the same time, it can prevent the blended pastes from flowing back into the tube, and from being blended to the unblended pastes, which will cause the contents separately contained in the inner tube and the outer tube to be polluted.

The dual tube container with one way valves of the present invention comprises an outer tube, wherein, the internal lower opening of the tube head of the outer tube is provided with a base plate; the base plate is provided with a left through hole connecting the inner chamber of the outer tube body, and a right through hole connecting the inner chamber of an inner tube body; a connector extends downwards from the right through hole, and the inner tube body located in the outer tube body is snapped to the connector to form the inner tube;

a pair of one way valves, the two one way valves being fixed on the base plate of the tube head, and being separately corresponding to the left through hole and the right through hole on the base plate;

an applicator, the applicator including a fixing part and a daub part with a orifice, the applicator being inserted into the tube head of the outer tube via its fixing part;

a separator, the separator being vertically fixed in the inner chamber of the applicator, which divides the inner chamber of the applicator into a left channel and a right channel; and a cap, and a pintle being located in the cap, when the cap is put on to close the tube head, the pintle in the cap sealing the orifice on the daub part of the applicator to prevent the leaking of liquid contents.

Wherein, the pair of one way valves comprises: a valve seat, the bottom surface of the valve seat being provided with a left guide hole and a right guide hole, a plug extending downwards from the right guide hole, the plug being inserted into the right through hole at the upper opening part of the connector below the base plate of the tube head; a flexible valve plate, the flexible valve plate being attached to the upper surface of the left guide hole and right guide hole on the bottom surface of the valve seat, the middle of the valve plate being compacted via the lower end of the separator, the left end part and the right end part of the valve plate are able to push open when the inner tube content or outer tube content is squeezed out. The one way valves are closed normally when the tube content is not squeezed.

The tube head of the outer tube, the base plate at the internal lower opening of the tube head, and the connector beneath the base plate are one plastic tube head component, which is made by injection molding or compression molding; as it is being formed, it forms a one body component with the flexible outer tube body. The flexible inner tube body without heading is snapped on the connector of the plastic tube head component to compose the inner tube.

The daub part of the applicator is a slanting daub part, the slanting daub tip of the slanting daub part is provided with multiple orifices to be sealed by a dual cap. The dual cap including an outer cap and a rotatable inner cap assembled in the outer cap, the inner cap having a barrel shape shell and a slanting plate located at the inner chamber of the barrel shape shell, an elastic gasket or multiple pintles being attached to the lower surface of the slanting plate for sealing the corresponding orifices of the slanting daub tip.

A method for making a dual tube container with applicator without a special filling and sealing equipment comprise the following steps:

a. by injection molding or compression molding to produce a flexible outer tube body with a tube head, a base plate provided with a left and a right through hole forming at the internal lower opening of the tube head; a connector extending downwards from the right through hole;

b. a flexible inner tube body being inserted into the connector to become a dual tube container;

c. the outer tube body and the inner tube body being sealed;

d. two different contents being separately filled to the inner chambers of the outer tube body and the inner tube body via the left, right through holes in the tube head; and e. an applicator with one way valves is inserted into the tube head; then put the cap on the tube head to close the dual tube container.

The dual tube container is provided with a pair of built-in one way valves; its inner tube is eccentrically or concentrically located in the outer tube; when the cap is opened, via the opening or closing of the built-in one way valves, the contents of the outer tube and the inner tube are permitted or forbidden to flow out.

Wherein, the tube head component comprises the tube head of the outer tube, the base plate at the internal lower opening of the tube head, and the connector below the base plate; the outer tube body and the tube head forms a one body component by welding; the inner tube body is directly snapped to the connector, so as to form the inner tube, and the process of making the tube head part of a traditional inner tube is saved; it is convenient for assembling, carrying and using.

The liquid out paths of the inner tube and the outer tube are separately controlled by a one way valve; the two kinds of contents in the inner tube and the outer tube will not be blended before they flows out, so as to avoid the disadvantages of traditional products that the contents in the inner tube and the outer tube will be blended before they are squeezed out. At the same time, when the tube body is squeezed to generate a resilience pressure, it can prevent the blended contents from being sucked back in to the tube, to keep the meaning of separately containing the contents in the inner tube and the outer tube.

By using the dual tube container to make a cosmetics apparatus, etc., the technology of filling two kinds of pastes can be implemented via the big holes in the tube head; that is, first the tube tails are sealed, after pastes are separately filled to the inner chambers of the outer tube and inner tube from the comparatively big left through hole and the right through hole in the tube head, and then the one way valves, the applicator and the cap are fixed. The present invention does not need expensive tube-in-tube special apparatus for filling and tail sealing; the operation of filling the contents and sealing the tube is greatly simplified, which is convenient for reducing the production cost.

DESCRIPTION OF THE PREFERRED EMBODIMENT

Aspects of the present invention are best understood from the following detailed description when read with reference to the accompanying figures.

Figure 1:
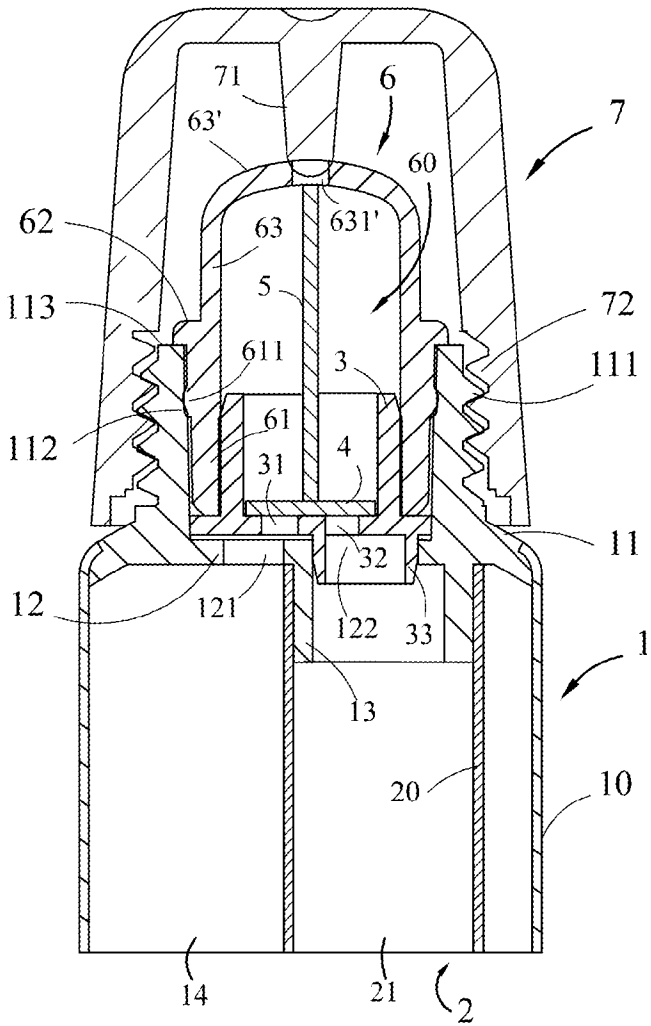
FIG. 1 is a structure schematic diagram of the embodiment 1 of the present invention.
Figure 2:
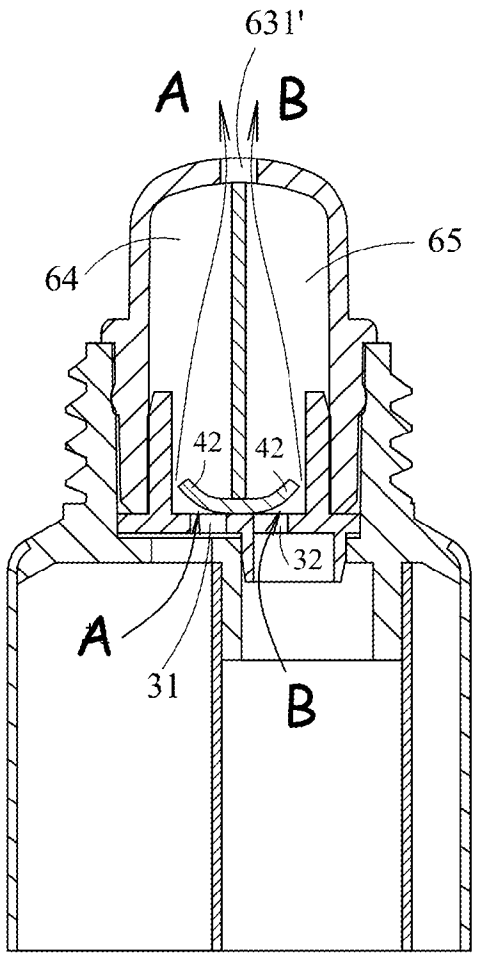
FIG. 2 is a schematic diagram of the embodiment 1 in FIG. 1 with the cap being removed, which shows the open state of the built-in one way valves.

Referring to FIG. 1 and FIG. 2, the dual tube container with one way valves of the embodiment 1 mainly comprises an outer tube 1, an inner tube 2, an applicator 6, a cap 7, and one way valves, etc.

The internal lower opening of the tube head 11 of the outer tube 1 is provided with a base plate 12; the base plate 12 is provided with a left through hole 121 connecting the inner chamber of the outer tube body 10, and a right through hole 122 connecting the inner chamber of the inner tube body 20; a connector 13 extends downwards from the right through hole 122, and the inner tube body 20 located in the outer tube body 10 is eccentrically snapped to the connector 13 to form the inner tube 2. The outer tube body 10 and the inner tube body 20 both adopt traditional flexible plastics, such as Polyethylene, to be preformed.

Wherein, the tube head 11 of the outer tube 1, the base plate 12 at the internal lower opening of the tube head 11, and the connector 13 below the base plate 12 are one plastic tube head component, which is made by injection molding or compression molding; as it is being formed, it forms a one body component with the flexible outer tube body 10.

The connector 13 of the above mentioned plastic tube head component and the flexible inner tube body 20 snapped to the connector 13 compose the inner tube 2. The making of a traditional inner tube head is saved.

The applicator 6 is a hollow structure, and it comprises a fixing part 61 and a daub part 63; the daub tip 63' of the daub part 63 is provided with a orifice 631'; the fixing part 61 is provided with a ring rib 611; the fixing part 61 is fixed in the tube head 11 of the outer tube, and its ring rib 611 is connected to the concave ring 112 of the inner wall of the tube head 11 by lock joint; the retaining margin 62 at the middle of the applicator 6 abuts against the upper end face 113 of the tube head 11.

A pair of one way valves are fixed on the base plate 12 of the tube head 11. The pair of one way valves comprise: a valve seat 3, the upper part of the valve seat 3 being inserted into the fixing part 61 of the applicator 6, the bottom surface of the valve seat 3 being provided with a left guide hole 31 and a right guide hole 32, the two guide holes being separately corresponding to the left through hole 121 and the right through hole 122 on the base plate 12 of the tube head 11; a plug 33 extending downwards from the right guide hole 32, the plug 33 being inserted into the right through hole 122 at the upper opening part of the connector 13 below the base plate 12 of the tube head 11; and, a flexible valve plate 4, the valve plate 4 being attached to the upper surface of the left guide hole 31 and right guide hole 32 on the bottom surface of the valve seat 3 to seal the left guide hole 31 and right guide hole 32, the middle of the valve plate 4 being compacted via a separator 5.

The separator 5 is vertically jammed in the jamming groove (not shown in the figure) on the inner chamber wall of the applicator 6; the lower end of the separator 5 presses against the middle of the valve plate 4 of the pair of one way valves, and the upper end presses against the orifice 631' at the daub tip 63' of the daub par 63 of the applicator 6, which divides the inner chamber of the applicator 6 into a left channel 64 and a right channel 65; the left left channel 64 and the right channel 65 are both connected to the orifice 631' of the applicator 6.

The inner surface of the top end of the cap 7 is provided with a tapered pintle 71; the internal opening of the cap 7 is provided with an internal thread 72 cooperating with the external thread 111 of the tube head 11 of the outer tube 1; when the cap 7 is fixed to the tube head 11 by screwing; the pintle 71 seals the orifice 631' of the applicator 6.

Referring to FIG. 2, the cap 7 is opened to open the orifice 631' of the daub part 63 of the applicator 6; while squeezing the tube body by hand, the content A in the outer tube 1 pushes upwards the left end part 41 of the valve plate 4, and the content B in the inner tube 2 pushes upwards the right end part 42 of the valve plate 4, so the two one way valves are opened; the content A in the outer tube 1 flows out from the orifice 631' of the daub part 63 of the applicator 6, via the left guide hole 31 on the bottom surface of the valve seat 3 and the left channel 64 of the applicator 6; the content B in the inner tube 2 flows out from the orifice 631' of the applicator 6, via the right guide hole 32 on the bottom surface of the valve seat 3 and the right channel 65 of the applicator 6, which will not be blended to the content A in the outer tube 1 before they flow out. This design can prevent the contents in the inner tube and the outer tube from being blended before they are not squeezed out. At the same time, when the tube body is squeezed to generate a resilience pressure, it can prevent the blended contents from being sucked back in to the tube, to keep the meaning of separately containing the contents in the inner tube and the outer tube.

While stopping squeezing the tube body, the left end part 41 and the right end part 42 of the valve plate 4 automatically return downwards to separately seal the left guide hole 31 and the right guide hole 32 on the bottom surface of the valve seat 3; the two one way valves are closed to prevent the content A entering into the left channel 64 and the content B entering the right channel 65 of the applicator 6 from flowing back. The cap 7 is locked to make the pintle 71 in the cap 7 to seal the orifice 631' of the daub part 63 of the applicator 6, that is, to recap to the state of FIG. 1. Wherein, the contents A, B are pasty or liquid contents, such as a lipstick, an ointment, and a hair dye.

The daub part of the above mentioned applicator can also be provided with daub apparatus such as a brush head. The shape of the daub part can cooperate with the daubing of the contents; its shape can be spheroidal, bevel, etc., and its material can be plastics, thermoplastic elastomers, rubber, and rubber foam, etc.

Figure 3:
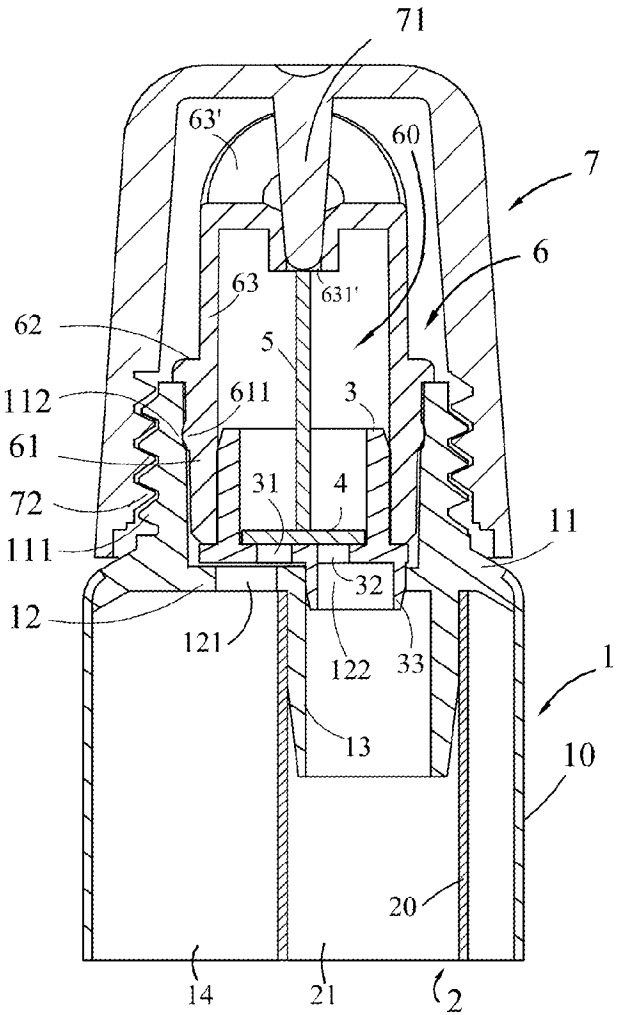
FIG. 3 is a structure schematic diagram of the embodiment 2 of the present invention.
Figure 4:
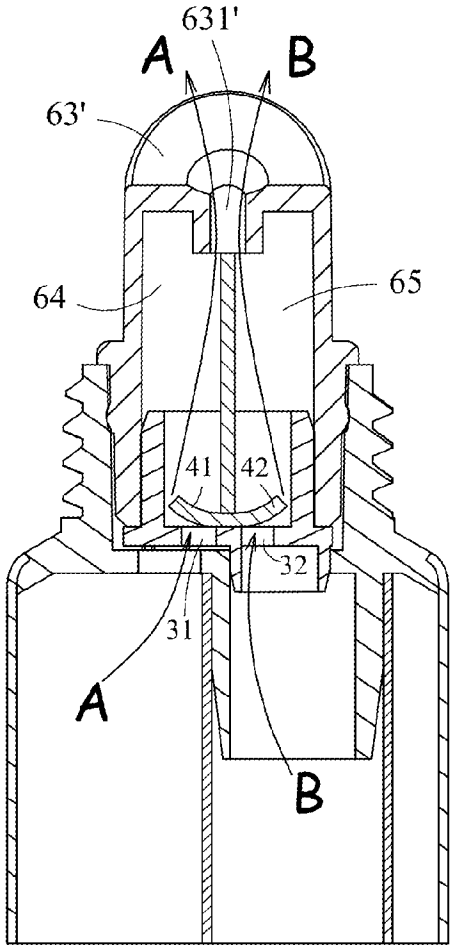
FIG. 4 is a schematic diagram of the embodiment 2 in FIG. 3 with the cap being removed, which shows the open state of the built-in one way valves.

The dual tube container of the embodiment 2 is shown in FIG. 3, and FIG. 4. The embodiment 2 mainly comprises an outer tube 1, an inner tube 2, an applicator 6, a separator 5, a cap 7, and one way valves 3, 4, excite is basically the same with the embodiment 1, and the difference is that its applicator 6 is of slanting head type structure. The applicator 6 is also of hollow structure, and it comprises a fixing part 61 and a slanting daub part 63; the slanting daub tip 63' of the slanting daub part 63 is provided with a orifice 631'; the fixing part 61 is provided with a ring rib 611; the fixing part 61 is fixed in the tube head 11 of the outer tube, and its ring rib 611 is connected to the concave ring 112 of the inner wall of the tube head 11 by lock joint; the retaining margin 62 at the middle of the applicator 6 abuts against the upper end face 113 of the tube head 11.

The inner surface of the top end of the cap 7 is provided with a tapered pintle 71; the internal opening of the cap 7 is provided with an internal thread 72 cooperating with the external thread 111 of the tube head 11 of the outer tube 1; the cap 7 is fixed to the tube head 11 by screwing; the pintle 71 close seals the orifice 631' of the applicator 6. FIG. 4 is a schematic diagram of the embodiment 2 with the cap being removed, which shows the open state of the built-in one way valves, and its action principle is the same with the description to FIG. 2.

Figure 5:
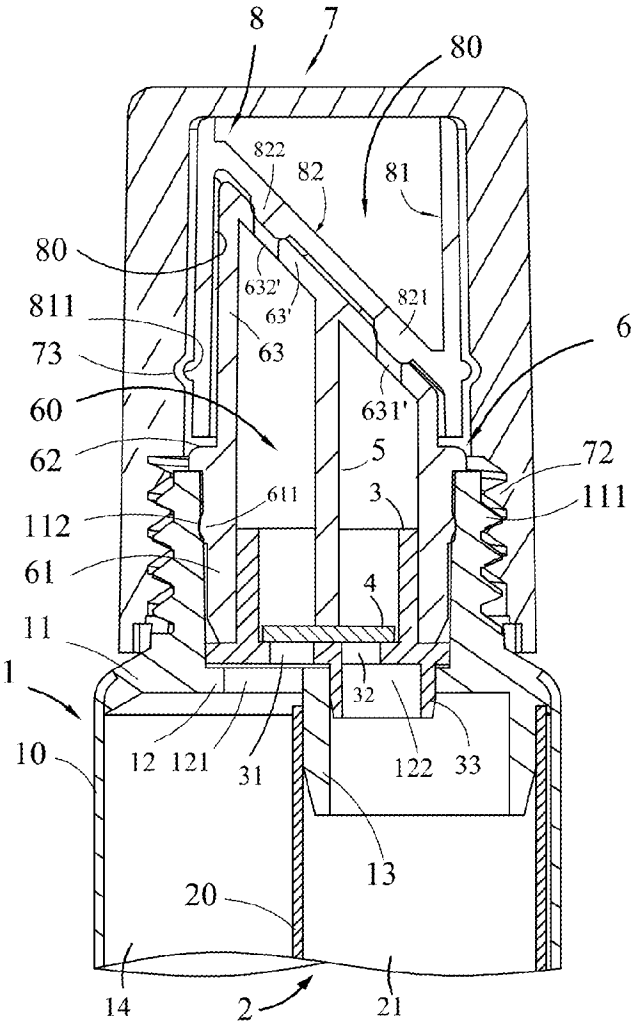
FIG. 5 is an integral structure schematic diagram of the embodiment 3 of the present invention.

When the applicator of the present invention adopts a slanting daub part with multiple orifices, a dual cap can be cooperate with it. As shown with the embodiment 3 of FIG. 5, this kind of dual tube container comprises an outer tube 1, an inner tube 2, an applicator 6, dual cap 7, 8 and one way valves, etc.

The internal lower opening of the tube head 11 of the outer tube 1 is provided with a base plate 12; the base plate 12 is provided with a left through hole 121 connecting the inner chamber of the outer tube body 10, and a right through hole 122 connecting the inner chamber of the inner tube body 20; a connector 13 extends downwards from the right through hole 122, and the inner tube body 10 located in the outer tube body 10 is snapped to the connector 13 to form the inner tube 2.

The applicator 6 is a hollow slanting head type daub head, which comprises a fixing part 61 and a slanting daub part 63; its inner chamber is provided with a separator 5, and the separator 5 divides the inner chamber into a left channel and a right left channel; the fixing part 61 is provided with a ring rib 611; the fixing part 61 is fixed in the tube head 11 of the outer tube, and its ring rib 611 is connected to the concave ring 112 of the inner wall of the tube head 11 by lock joint. The slanting daub tip 63' of the slanting daub part 63 is provided with two groups of orifices 631', 632'; the lower group of orifices 631' is connected to the right left channel, and the higher group of orifices 632' is connected to the left channel in the daub head; each group of orifices comprises at least one orifice.

The structure and installation method of the pair of one way valves are the same with the embodiment 1; they are fixed on the base plate 12 of the tube head 11, and the middle of the valve plate 4 is compacted via the lower end of the separator 5.

The dual cap 7, 8 comprises an outer cap 7 and a rotatable inner cap 8; the inside of the outer cap 7 is provided with an internal thread 72; the inner cap 8 is rotatablely fixed to the inner upside of the outer cap 7; the inner cap 8 includes a barrel shape shell 81 and a slanting plate 82 located at the inner chamber of the barrel shape shell 81; two groups of pintles 821, 822 extend from the lower surface of the slanting plate 82, and each group of pintles comprises at least one pintle. The outer wall of the barrel shape shell 81 is provided with a ring rib 811, and the corresponding position of the inner wall of the outer cap 7 is provided with a ring groove 73 having movable fit with the ring rib 811.

During the course of screwing the dual cap to be fixed to the tube head 11 of the outer tube, the slanting daub part 63 of the applicator 6 gradually extends into the inner cap 8, and the inner cap 8 is made to rotate relative to the outer cap 7; until the slanting plate 82 of the inner cap 8 is parallel to the slanting daub tip 63' of the slanting daub part 63, the outer cap 7 is further locked to the tube head 11, and the inner cap 8 follows to move downward; finally the two groups of pintles 821, 822 of the lower surface of the slanting plate 82 of the inner cap 8 separately seal the two groups of orifices 631', 632' located at the slanting daub tip 63', so as to prevent the two kinds of contents filled inside from flowing out.

Figure 6:
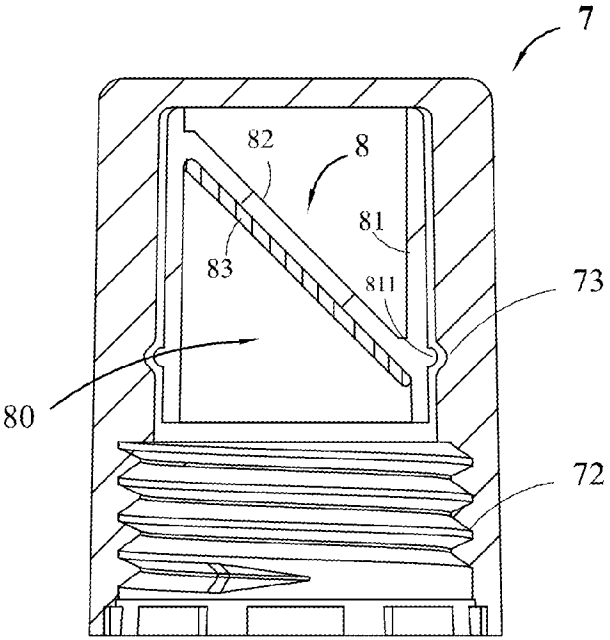
FIG. 6 is a schematic diagram of another variational structure of the dual cap 7, 8 in the embodiment 3 in FIG. 5.

Another variational structure of the dual cap in the embodiment 3 is as shown in FIG. 6. The variational structure is basically the same with the dual cap in FIG. 5, and the difference is that an elastic gasket 83 is attached below the slanting plate 82 of the rotatable inner cap 8; after the dual cap are turned to be fixed, the two groups of orifices 631', 632' located on the slanting daub tip 63' of the applicator 6 are sealed via the elastic gasket 83 below the slanting plate 82.The elastic gasket 83 is a rubber gasket, or an elastic plastic gasket, etc.

The method for making a cosmetics container with applicator of the present invention comprises the following steps that:

a. one end of a flexible outer tube body 10 is inserted into the mould of the tube head component; the tube head component is molded by plastic injection molding or compression molding, and at the same time, the joint part of the outer tube body 10 is connected to the tube head 11 of the tube head component together with; a base plate 12 provided with a left, right through hole 121, 122 forms at the internal lower opening of the tube head 11; a connector 13 extends downwards from the right through hole 122;

b. a flexible inner tube body 20 is inserted into the outer tube body 10, and one end of the inner tube body 20 is connected to the lower section of the connector 13 of the tube head component;

c. the tails of the outer tube body 10 and the inner tube body 20 are sealed by heat sealing;

d. two kinds of pastes are separately filled to the inner chambers of the outer tube body 10 and the inner tube body 20 via the left, right through holes 121, 122 in the tube head 11; and e. an applicator 6 with a pair of one way valves 3, 4 is inserted to be fixed to the tube head 11; the cap 7 is turned to close, so as to make the pintle 71 in the cap 7 to seal the corresponding orifice of the daub part 63 of the applicator 6.

Although the present invention has been described in detail with above said preferred embodiments, but it is only to make the people skilled in the art to understand the present invention, not to limit the scope of the present invention. For those skilled in the art, all the modifications and changes according to the characteristic and spirit of the present invention, are involved in the protected scope of the present invention.

What is claimed is:

1. A dual tube container comprising:

an outer tube comprising:

an outer tube body having an outer tube interior chamber; and, an inner tube comprising an inner tube body having an inner tube interior chamber;

a tube head comprising:

a base plate having a left through hole communicating with the outer tube interior chamber, and a right through hole communicating with the inner tube interior chamber; and, a connector joining the inner tube body, the connector being adjacent the right through hole and extending downward from the base plate;

an applicator inserted into the tube head, the applicator comprising:

an applicator interior chamber;

a separator vertically fixed within the applicator interior chamber, the separator dividing the applicator interior chamber into a left channel and a right channel;

a fixing part; and, a daub part with at least one orifice;

a pair of one way valves fixed on the base plate, the pair of one way valves each separately corresponding to the left through hole and to the right through hole, the pair of one way valves comprising:

a valve seat, having a bottom surface provided with a left guide hole and a right guide hole with a plug extending downwards from the right guide hole, the plug inserted into the right through hole of the base plate; and, a flexible valve plate, the flexible valve plate attached to an upper surface of the left guide hole and an upper surface of the right guide hole and the flexible valve plate attached to the bottom surface of the valve seat, a middle of the valve plate compacted by a lower end of the separator, a left end part and a right end part of the valve plate open when inner tube contents or outer tube contents are dispensed;

a cap comprising a pintle located within the cap, the pintle sealing the at least one orifice of the daub part to prevent the leaking of liquid contents when the cap is attached to the tube head.

2. The dual tube container of claim 1, the daub part further comprising a daub tip which comprises the at least one orifice of the daub part, the at least one orifice communicating with the left channel or the right channel.

3. The dual tube container of claim 1, wherein the inner tube body is located within the outer tube body and the inner tube body is snapped to the connector to close the inner tube.

4. The dual tube container of claim 1, wherein an internal thread at an internal lower opening of the cap is screwed to an external thread of the tube head and the pintle seals the at least one orifice of the daub part to prevent the leaking of the liquid contents.

5. The dual tube container of claim 1, wherein the daub part is a slanted shape having a slanting daub tip comprising the at least one orifice which are multiple orifices sealed by a dual cap.

6. The dual tube container of claim 5, wherein the cap further comprises an outer cap and a rotatable inner cap having a barrel-shaped shell and a slanting plate located at a barrel-shaped shell interior chamber, and an elastic gasket or multiple pintles attached to a lower surface of the slanting plate for sealing the corresponding multiple orifices.

7. The dual tube container of claim 1, wherein the tube head, the base plate, and the connector compose a single unitary monolithic plastic component made by injection molding or compression molding.

8. The dual tube container of claim 7, wherein the inner tube body is located within the outer tube body and the inner tube body is snapped to the connector to close the inner tube.

9. The dual tube container of claim 7, wherein an internal thread at an internal lower opening of the cap is screwed to an external thread of the tube head and the pintle seals the at least one orifice of the daub part to prevent the leaking of the liquid contents.

* * * * *